United States Patent [19]

Ciriscioli

[11] Patent Number: 4,758,699

[45] Date of Patent: Jul. 19, 1988

[54] PRESSURE RESPONDER

[75] Inventor: Peter R. Ciriscioli, Reno, Nev.

[73] Assignee: L.C.P., Inc., Reno, Nev.

[21] Appl. No.: 837,907

[22] Filed: Mar. 10, 1986

[51] Int. Cl.[4] ..... H01H 13/52

[52] U.S. Cl. ..... 200/159 R; 200/243; 200/5 A; 200/340; 200/327

[58] Field of Search ..... 200/243, 227, 59 R, 200/340, 5 A, 5 R

[56] References Cited

U.S. PATENT DOCUMENTS

| | | | |
|---|---|---|---|
| 540,949 | 6/1895 | Clark | 200/159 R |
| 866,377 | 9/1907 | Mebold | 200/159 R |
| 1,239,054 | 9/1917 | Sparks | 200/159 R |
| 1,598,008 | 8/1926 | Phillips | 200/159 R |
| 1,604,819 | 10/1926 | Gaynor | 200/159 R |
| 1,726,335 | 8/1929 | Benjamin | 200/159 R |
| 1,779,133 | 10/1930 | Knudsen | 200/159 R |
| 2,881,292 | 4/1959 | Winter et al. | 200/340 |
| 2,951,926 | 9/1960 | Frantz et al. | 200/159 R |
| 4,389,549 | 6/1983 | Brown | 200/5 R |

*Primary Examiner*—Henry J. Recla
*Assistant Examiner*—Ernest G. Cusick
*Attorney, Agent, or Firm*—Lothrop & West

[57] ABSTRACT

A thimble-shaped button actuator largely formed of insulating material has a cup-like base with an inside step and is symmetrical about an axis. A thimble is reciprocable in the base along the axis. A spring is seated against the closed end of the base and the closed end of the thimble and urges the thimble in a direction away from the base and against a snap ring in the base in the path of a flange on the thimble. An electrically conducting ring on the thimble is moved by axial pressure on the thimble to abut a pair of electrical conductors seated in the base and overlying the step. Electrically conducting binding screws are recessed in and pass into the base to engage threads in the conductors.

3 Claims, 1 Drawing Sheet

PRESSURE RESPONDER

BACKGROUND OF THE INVENTION

Field of the Invention

The invention is in the field of electric circuit "off" and "on" switches actuated in response to pressure differences, particularly for use with pressure or vacuum forming bags, and of small size, economical cost and ready adaptation to a particular environment.

A typical environment for the device is in connection with a vacuum bag utilized in curing composite laminates especially for aerospace use. The composite laminate is, for example, an impregnated fiberglass cloth put against a suitable mold, the cloth being forced to take the contour of the mold by either a pressure bag or a vacuum bag. A number of the thimble-shaped button actuators or responders are positioned inside a bag extending substantially horizontally over a panel to be cured. The bag is evacuated and the actuator responders correspondingly collapse and so indicate when the vacuum is at a predetermined value or is complete. Should there be a leak, some of the actuators or responders near the leak lose contact and afford a corresponding indication. Similarly, if the bag operates under pressure against a surface, actuators or responders are interposed between the bag and the surface and collapse to indicate a preselected pressure. The actuators or responders can easily be changed to respond to vacuum or subatmospheric pressures and for relatively high pressures. A representative thimble-shaped actuator or responder is described in the accompanying description and is shown in the accompanying drawings.

SUMMARY OF THE INVENTION

A pair of nested, recessed members of electrically insulating material are telescoped by pressure in one direction along an axis to move in that direction against the urgency of a helical spring axially disposed within the recesses. The movement displaces an annular electrical conductor on one member axially into abutment with a pair of electrical conductors on the other member. When the members telescope and move in the opposite direction along the axis, the inner member is stopped at the end of its travel by a split ring partially seated in a groove in the outer member, the ring being abutted by a flange at the other end of the inner member. Electrically conducting screws recessed in and extending into the other member engage threads in the conductors. A snap ring limits relative movement of the members along the axis in the opposite direction.

DESCRIPTION OF PREFERRED EMBODIMENTS

Figure 1:
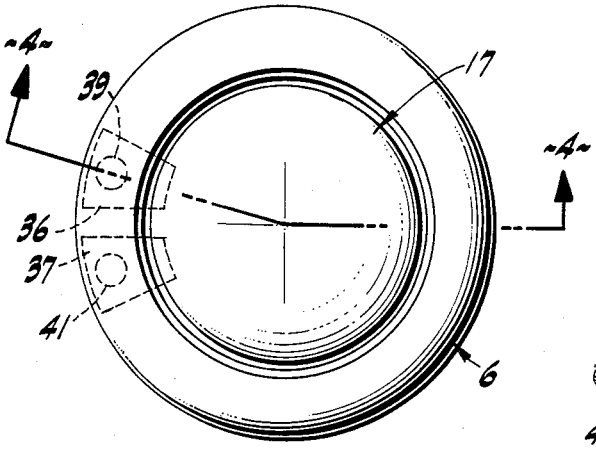
FIG. 1 is a top plan view of a structure pursuant to the invention.
Figure 2:
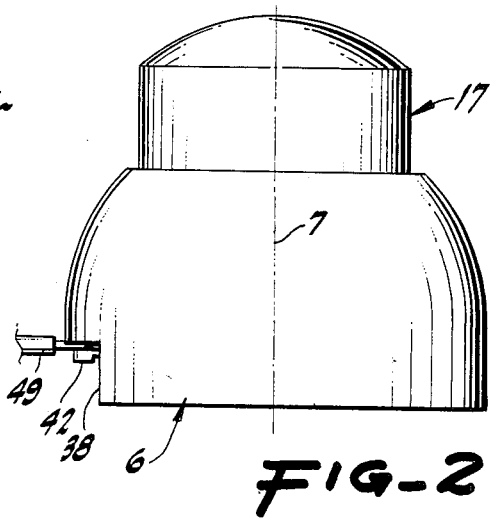
FIG. 2 is a side elevation of the structure of FIG. 1.
Figure 4:
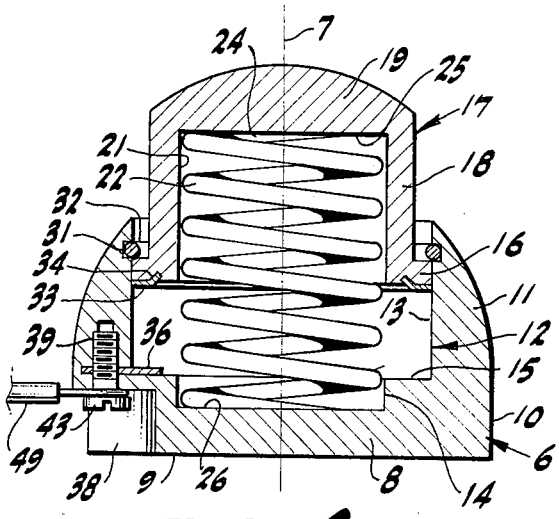
FIG. 4 is a cross-section, the plane of which is indicated by the line 4—4 of FIG. 1, and shows the device in an unstressed condition.
Figure 5:
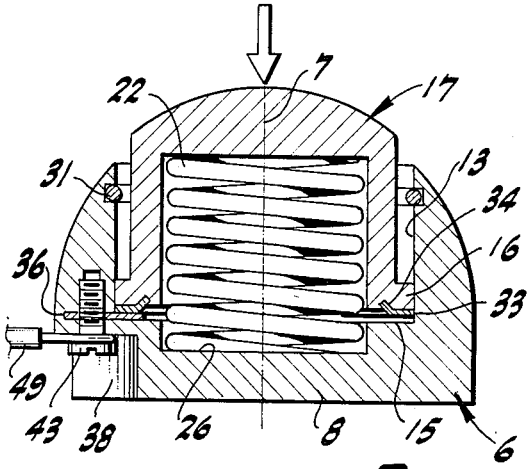
FIG. 5 is a view comparable to FIG. 4 but shows the device in a stressed condition.

In an exemplary and preferred embodiment, the pressure actuator or responder includes a base 6 preferably fabricated by molding an electrically nonconducting reinforced material such as a plastic with fiberglass inclusions. The base is conveniently circular in plan and is symmetrical about an axis 7, being inclusive of a bottom wall 8 having a lower planar surface 9 and an approximately cylindrical side wall 10 merging into a spherical side wall portion 11. The walls 10 and 11 are surfaces of revolution about the axis 7. The base is largely hollow, having a central circular cylindrical recess 12 defined by a side wall 13 circular about the axis 7, closed by the bottom wall 8 and open at the top. The base is cup-like. The recess 12 is of a relatively large diameter and opens into a relatively smaller diameter recess 14 leaving an intermediate step 15 of a planar or annular nature normal to and centered on the axis 7.

Arranged to reciprocate within the recess 12 and to slide easily along the wall 13 thereof is a flange 16 of an annular configuration. The flange 16 is at the lower end of a similar, reinforced plastic thimble-shaped button actuator sometimes referred to herein synonymously as a "thimble". This part is circular cylindrical for the most part and concentric with the axis 7. The side wall 18 of the thimble merges with a top wall 19 conveniently of generally dome or globular or partly sphered shape. The inside of the thimble has a circular-cylindrical wall 21 freely receiving one end of a helical spring 22 made of metal wire preferably circular in cross-section and formed with a flattened or ground end such as 24 and a similarly flattened opposite end designed to abut closely the adjacent end walls 25 and 26 of the thimble and base. Since the spring is arranged to exert a force in an outward or separating direction, there is provided a removable and deformable split ring, snap ring or stop ring disposed in a groove 32 in and near the top of the wall of the base and in the path of the flange 16. Customarily, the spring 22 is maintained in a somewhat compressed condition, but upon exertion of a superior downward axial force on the thimble tending to move the thimble and the base toward each other or together, the spring 22 is compressed and resists such motion.

Situated on the lower face of the flange 16 and preferably disposed thereagainst is a ring contact 33 in concentric, radially spaced relationship with the axis 7. The ring 33 is of electrically conducting material and is not only planar for the most part, but also has an upturned flange 34. This flange 34 is adapted to be molded into the material of the thimble 17 so as to hold the ring contact 33 in position concentric with the axis 7 and also radially spaced from and surrounding the axis.

Figure 3:
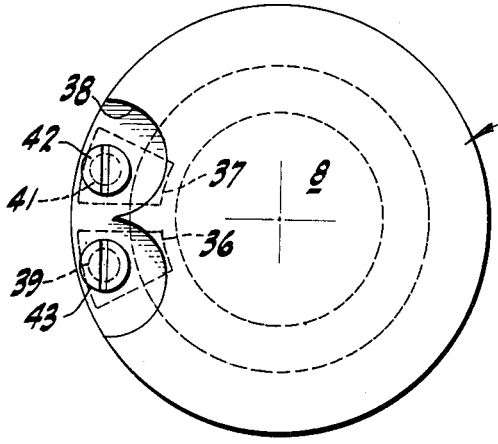
FIG. 3 is a bottom plan view of the structure.

On the base 6 and particularly adjacent the wall 10 thereof, there is provided a pair of circumferentially seperated electrical conductors 36 and 37. These not only overlie the top of the ledge or intermediate step 15, but also extend into and are embedded within the side wall portion 11 of the base. Just below or adjacent to the conductors 36 and 37, the base 6 is configured to afford a recess 38 of an approximate FIG. 3 shape in plan. The walls of the recess 38 are arcuate around threaded bores 39 and 41 in the base 6. Binding screws 42 and 43 are disposed within the recess 38 and are protected thereby. The screws 42 and 43 are passed through the base material and engage into threaded apertures in the base.

In an exemplary use of the device, the base 6 is mounted appropriately in a suitable location, usually by adhesion between the surface 9 and a proper support. The binding screws 42 and 43 are slacked off, electrical conducting wires 49 of an external circuit are suitably positioned thereon, and the screws are tightened. This puts the conductors 36 and 37 in an external circuit, although the circuit is not then closed because the conductors are not then joined. When downward pressure is exerted on the top of the thimble 17, the resulting unbalanced force tends to telescope the thimble 17 into the base 6 and to move the thimble in a downward direction toward the base. This motion effectuates a compression of the helical spring 22 until the resistance of the spring is entirely overcome and the contact ring 33 abuts and electrically bridges the conductors 36 and 37. Bridging occurs only when the downward pressure on the thimble 17 is sufficient to afford the necessary compression of the spring 22 to allow the predesigned amount of axial movement of the thimble 17 with respect to the base. When electrical contact is so made, it is customary to have a remote signal to show that a set pressure has been exerted on the thimble. Normally the thimble is translated in a rectilinear, axial fashion due to increase in pressure, but should the thimble for any reason rotate about the axis 7 in its telescoping movement, that is immaterial because the contact 33 is annular and in any rotated position will effect a circuit closure between the conductors 36 and 37. During the telescoping movement of the parts, the spring is maintained in its coaxial location because one end is substantially confined in the recess 14 in the base, whereas the other end is substantially confined in the recess defined by the wall 21 in the thimble.

At the conclusion of a test, the unit may be discarded or can be removed for future use. At any time desired, the snap ring 31 can be pried out of position and the thimble 17 can be extracted from the base 6 with or without the assistance of the spring 22, and the spring itself can be removed. Reassembly of the spring and thimble is by a reverse order of procedure. Springs of different strength can be interchanged to fit the unit to various duties.

The construction of the unit is extremely simple, relatively inexpensive, and the unit is highly effective for a single use and discard or for repetitive or different uses, depending upon the requirements.

I claim:

1. A top-accessible push button switch comprising a base bottom wall and a cylindrical base side wall upstanding from said base bottom wall and therewith defining a bottom cup closed at the bottom and open at the top, an actuator button having a top cap and a top side wall projecting from said top cap and therewith defining a top cup adapted to be disposed within said bottom cup, said top side wall having a bottom, an outstanding flange around the bottom of said top side wall adaptable for reciprocation in a predetermined path within said bottom cup against said base side wall thereof, a helical spring adapted to abut said top cup and said bottom cup, means including a split ring removably mounted on said base side wall and projecting inwardly into said bottom cup near the top thereof and into said path for limiting said reciprocation of said top cup in said bottom cup, an electrical contact on said bottom of said top side wall, and a pair of electrical conductors on said base bottom wall in position to be abutted by said contact.

2. A top-accessible restrainer for a push button slidable in a housing comprising a base having a longitudinal axis, said base having a bottom wall substantially normal to said axis and having a side wall substantially circular about said axis and at one end merging with said bottom wall and open at the other end, means defining an inside step surface on said base disposed in a plane normal to said axis, means defining a groove concentric with said axis and disposed on said side wall open towards said axis, a thimble-shaped actuator having a closed top and an open annular bottom end, a flange on and outstanding from said bottom end and in sliding engagement with said side wall in a predetermined path between said groove and said bottom wall, a helical spring concentric with said axis and having one end against said bottom wall and having another end against said top of said thimble-shaped actuator, a removable snap ring in said groove and extending therefrom into said path, an electric contact concentric with said axis and mounted in and on the bottom end of said thimble-shaped actuator, a pair of electric conductors on said step surface of said base member beneath and in a path of abutment with said electric contact, and securing devices in engagement with said conductors.

3. A device comprising a base symmetrical about an axle, a substantially annular first wall having inside and outside surfaces upstanding on said base with the inside surface of said first wall concentric with said axis and having a bottom end and an open top end, a button actuator including a second wall having a bottom end, inside and outside surfaces with the outside surface of said second wall concentric with said axis and radially separated from said inside surface of said first wall to provide an annular space between said first wall and said second wall, a flange on said second wall near the bottom end outstanding therefrom across said annular space and into sliding engagement with the inside surface of said first wall, means defining a groove in said first wall concentric with an open toward said axis and at a predetermined axial distance below said top end, a deformable snap ring movable through said annular space to seat partially in said groove and partially to extend radially inwardly from said inside surface of said first wall into said annular space, a spring disposed to expand axially against said base and said actuator, and separate electrical contacts disposed on said base and said actuator in position to abut axially when said spring is compressed.

* * * * *